US006942040B1

(12) United States Patent
Phuong et al.

(10) Patent No.: US 6,942,040 B1
(45) Date of Patent: Sep. 13, 2005

(54) METHOD, CHEMICAL AND AUTOMATIC FIRE EXTINGUISHING SYSTEM USING LIQUIFIED $CO_2$ TO REGULATE THE DISTRIBUTION OF FIRE EXTINGUISHING AGENTS

(76) Inventors: Phan Dinh Phuong, 01-Le Quy Don, Danang (VN) 844; Phan Trong Nghia, 399/1 Hoang Diêu, Danang (VN) 844

( * ) Notice: Subject to any disclaimer, the term of this patent is extended or adjusted under 35 U.S.C. 154(b) by 403 days.

(21) Appl. No.: 09/856,294

(22) PCT Filed: Sep. 19, 2000

(86) PCT No.: PCT/VN00/00001

§ 371 (c)(1),
(2), (4) Date: May 1, 2002

(87) PCT Pub. No.: WO01/21261

PCT Pub. Date: Mar. 29, 2001

(30) Foreign Application Priority Data

Sep. 20, 1999 (VN) ..... S19990177

(51) Int. Cl.[7] ..... A62C 35/00; A62C 37/36

(52) U.S. Cl. ..... 169/5; 169/6; 169/7; 169/8; 169/9; 169/19; 169/37; 169/40

(58) Field of Search ..... 169/5–9, 13, 14, 169/16, 17, 19–22, 23, 26, 37, 40–42

(56) References Cited

U.S. PATENT DOCUMENTS

| | | | | |
|---|---|---|---|---|
| 3,525,402 | A * | 8/1970 | Hattori | 169/40 |
| 4,405,018 | A * | 9/1983 | Fischer | 169/37 |
| 5,036,923 | A * | 8/1991 | Shea, Sr. | 169/37 |
| 5,094,298 | A * | 3/1992 | Polan | 169/41 |
| 5,497,833 | A | 3/1996 | Kaylor | |
| 5,609,211 | A * | 3/1997 | Meyer et al. | 169/37 |
| 5,664,630 | A * | 9/1997 | Meyer et al. | 169/37 |

FOREIGN PATENT DOCUMENTS

| | | |
|---|---|---|
| EP | 0798019 A1 | 10/1997 |
| GB | 1236064 A | 6/1971 |
| JP | 07 024080 A | 1/1995 |
| SU | 1727856 A1 | 4/1992 |

* cited by examiner

*Primary Examiner*—Davis Hwu
(74) *Attorney, Agent, or Firm*—Lowe Hauptman & Berner, LLP

(57) ABSTRACT

The automatic fire extinguishing method using liquefied $CO_2$ to regulate the distribution of fire extinguishing agents characterised in that this method uses liquid $CO_2$ as: an independent fire extinguishing agent or combined with other fire extinguishing agents to create new fire extinguishing agents which have strong effects and high efficiency; as a dynamic source producing pressure in the tank to push fire extinguishing agents into the fire area, and as a dynamic source of the entire fire extinguishing system and automating the process.

2 Claims, 1 Drawing Sheet

Figure 1:
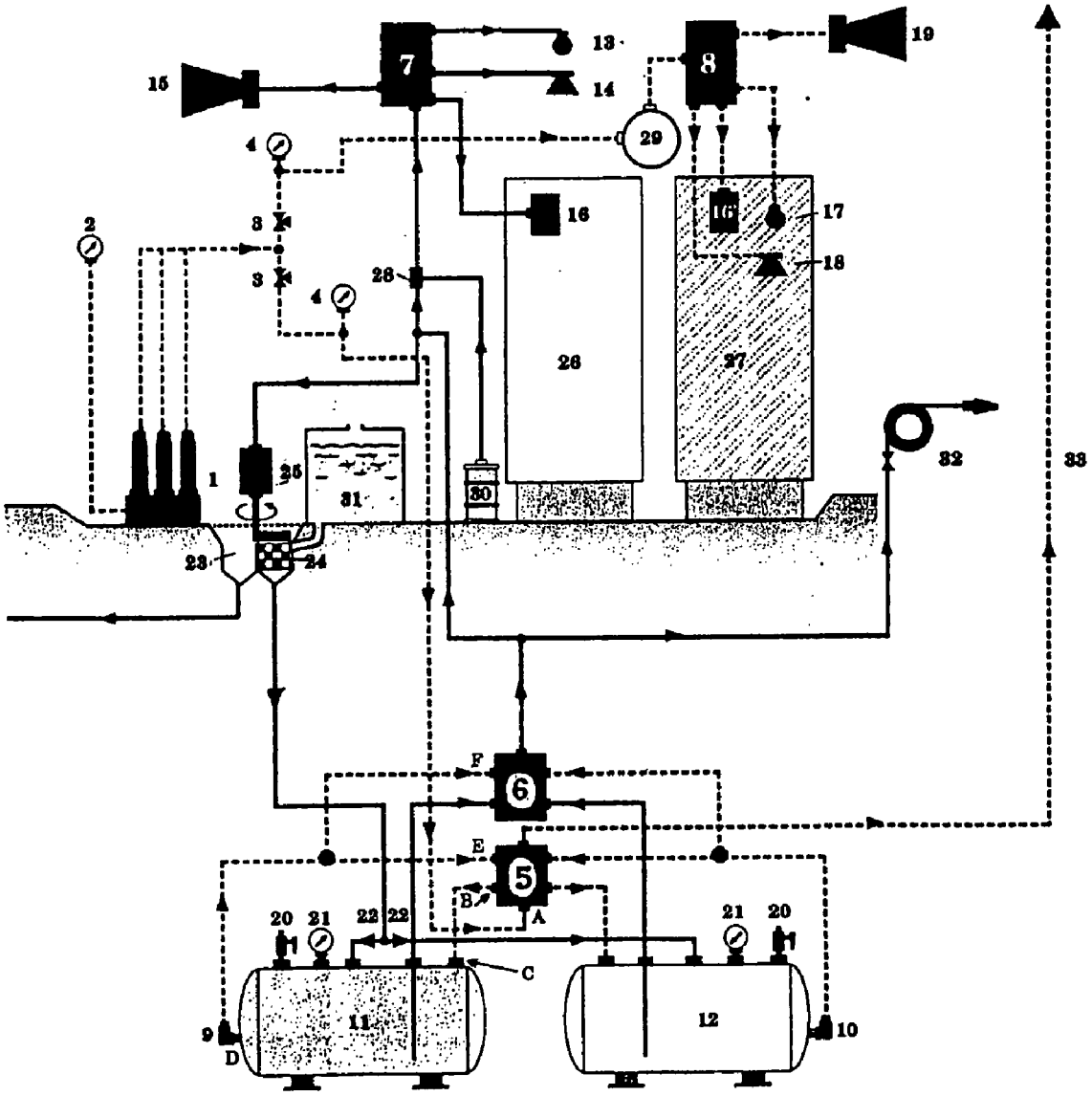

METHOD, CHEMICAL AND AUTOMATIC FIRE EXTINGUISHING SYSTEM USING LIQUIFIED $CO_2$ TO REGULATE THE DISTRIBUTION OF FIRE EXTINGUISHING AGENTS

1. FIELD OF THE INVENTION

The invention belongs to the ensuring safety aspect. In concrete, it automatically gives the alarm in case of fire and automatically ejects the fire extinguishing chemicals.

Note: The term fire extinguishing agents or fire extinguishing chemicals in its broad meaning indicates water, compound, suspension, emulsion, foam, powder, or their mixtures which are used to extinguish fires in suitable conditions.

2. BACKGROUND OF THE INVENTION

The current automatic fire extinguishing methods often use electric pumps with high power equipped with pressure relays connected to fire alarm sprinkler. In case of fire, the file alarm sprinkler is broken, thus reducing the pressure in the permanent system, and activate the relay which starts the pump to supply water to the fire extinguishing system. When the power is cut off, the pump operated by the reserved generator will function. To remedy the leak due to defective assemble, a third pump will a pressure relay connected with the system will automatic start to supply water continuously.

Advantages:

The automatic fire extinguishing system can quickly put out the fire if it is regularly maintained according to the technological requirements.

Disadvantages:

1. Depending on the Power Supply:
   The inevitable disadvantage of the technological solution is that the system is completely dependent on the power supply: if the power is disconnected and the generator breaks down, then the whole system is completely dead. Therefore, although there is no fire, the system must be regularly operated to check the reliability, which causes environmental pollution and constantly consumes electricity and petrol. Meanwhile, the fire extinguishing system itself cannot produce benefit to recover the invested capital.
   If the water tank is used to supply water automatically, pumps must be used to provide water, and the cost of building the water tank is very high.

2. Occupancy of Large Land Area:
   Being operated by high power, the fire extinguishing itself becomes a possible cause of fire; therefore it must be constructed a long way from the area to be protected, which takes up some land, and in case of fire, the system cannot protect itself.

3. High Consumption of Water:
   When the system operates to put out a fire, the water loss due to the effect of the fire is little, but the amount of water for cooling the nearby things runs to the gutter is much greater. Whereas, at the constructions where there is high possibility of fire and explosion, the safety regulations for fire prevention and protection require a great source of water for fire extinguishing, which is often beyond the supply capacity; therefore, it is necessary to build an additional pipe to suck water from natural sources, such as ponds, lakes, rivers, and streams, and even sea water to put out the fire. The quality of this supplementary source of water is often low, and it easily produces rust and blocks the fire extinguishing system and is likely to become exhausted in summer.

4. Reducing the Fire Extinguishing Capacity of Water and of the Automatic Fire Extinguishing System
   The cheapest and best fire extinguishing agent is water, but it is not used for putting out fires caused by petrol and oil, which is highly flammable because when water is added, petrol and oil will float on the water surface and will likely to spread the fire. However, if chemicals are mixed with water for extinguishing, after the fire being put out, it is this mixture that deteriorates petrol and oil.
   Each fire extinguishing pumping system has three pumps but they can supply only one fire extinguishing agent while the site often consists of different objects with various chemical and physical properties. Therefore, in many cases, after putting out the fire, the objects are also damaged by the fire extinguishing agent (i.e.: water destroys documents, electronic and electrical equipment, chemicals, food or when in contact with alkaline metals, calcium carbide, the fire will become even more violent, . . . )
   When the temperature is lower than O C, the water is iced, so the whole fire extinguishing system is halted.

5. Limiting the Promptness
   Due to the use of pumps, there is negative pressure in the sucking pipeline, which will make it difficult to be air-tightened. Even when the pumps are in good working condition, the fire extinguishing is still slow because they cannot suck water instantly.

6. The System has to be Imported at High Cost
   The system has three pumps with many automatic control cabinets which are interconnected, sophisticated, and sensitive. The higher power, it has the higher it costs (up to hundreds of thousands of US$); therefore, a quite large number of units, which are likely to suffer high fire risk, cannot afford to equip with the automatic fire extinguishing system.

3. SUMMARY OF THE INVENTION

The objectives of the solution are:

- Creating a multifunctional automatic fire extinguishing system, which is small in size and has sufficient energy in itself to operate without energy from the power line or generator to run the pumps.
- Being always ready and immediately providing sufficient pressure and flow of fire extinguishing agent during operation time.
- Low cost, high reliability and easily accessible to underdeveloped areas where there is no electricity available.
- Suitable for numerous scopes and constructions in need of fire extinguishing in various climate regions.
- Expanding the fire extinguishing area for water
- Creating new fire extinguishing agents with high efficiency on the basis of the already known agents.
- Saving the fire extinguishing agents to the maximum in order to minimise environmental pollution, while ensuring an amount of fire extinguishing agent sufficient enough for use compared with the stored quantity.

Expanding the capacity to meet various fire extinguishing needs for many constructions by using different fire extinguishing agents for only one fire extinguishing system.

The above objectives can be attained by using the following method, chemicals and automatic fire extinguishing system:

1. Automatic Fire Extinguishing Method Using Liquid $CO_2$ to Regulate the Distribution of Fire Extinguishing Agents:

This method uses liquid $CO_2$ as: an independent fire extinguishing agent or combined with other fire extinguishing agents to create new fire extinguishing agents which have strong effects and high efficiency; as a dynamic source producing pressure in the tank to push fire extinguishing agents into the fire area, and as a dynamic source of the entire fire extinguishing system and automating the process consisting of the following stages:

a. Preparation:

Deciding the amount and category of the fire extinguishing agent needed for the protection of the object in accordance with the regulations.

Deciding the liquefied $CO_2$ needed for the entire automatic fire extinguishing process, installing the permanent liquefied $CO_2$ containers on the scale or using the specialised level indicator to check the weight regularly and make an alarm in case of shortage.

Connecting the $CO_2$ containers and supplying $CO_2$ to the pressure adjusting device.

Adjusting the $CO_2$ supplies to the needed pressure as required by the fire extinguishing system to provide pressure for the fire extinguishing agent tanks, the device for opening and closing valves, the alarming system and automatic power switch-off system operated by pressurised air.

Pipelining the whole fire alarm and fire extinguishing system with a system consisting of 2 high pressure containers placed at positions favourable for recovering the fire agent which has been used. These two containers are able to alternate their functions of supplying or receiving the fire extinguishing agent after going through the settling and oil separating system.

With the exception of the water tank, the entire remaining permanent high pressure system is regularly supplied with stable $CO_2$ to dissolve $CO_2$ in the fire extinguishing agent, creating new fire extinguishing agents and making them ready for operation.

b. Fire Extinguishing:

In case of fire, the temperature increases to the prescribed sprinkler, the fire alarm thermal sprinkler is broken discharging the fire extinguishing agent and creating a pressure decrease which activates the fire alarm and the power switch-off device of the protected object, and then pushing the fire extinguishing agent into the fire.

c. Recycling and Compensation of the Fire Extinguishing Agent:

After being used, the fire extinguishing agent discharged into the water drainage gutter is r recovered by: making a branching pipe from the fire extinguishing agent supplying pipeline, so that when the fire alarm signal is received, the reversing valve will automatically function to close the gate of the normal water waste drainage system and to allow the fire extinguishing agent to run through the settling, filtering, oil separating system through one-way valve and returning to the receiving container.

When the fire extinguishing agent in the container, which is in operation, becomes low, the level indicating float is lowered, opening the supplying pipe of $CO_2$ for the reversing device to open the valve supplying $CO_2$ increasing the pressure in the tank, which is already filled with the fire extinguishing agent, so that the fire extinguishing agent continued to spray, opening valve discharging the pressure in the low tank to turn it into a receiving container of the naturally returning fire extinguishing agent; at the same time receiving additional fire extinguishing agent from the reserved tank through the distribution system so as to fill up the container promptly.

The process is repeated until the fire extinguishing is completed.

d. Creating the varied capability to extinguish fires for the automatic fire extinguishing system by means of: branching various $CO_2$ pipes so as to push specialised fire extinguishing agents from their containers to the appropriate objects to avoid damage to them caused by the agents themselves. In concrete:

If water is used to extinguish fire directly for petrol, oil (or indissoluble substances and lighter than water), we should adjust the pressure and select the suitable type of drencher to ensure water is sprayed into mist with droplet size being as required by the technological specifications (smaller than 100 micrometers).

In case foaming agent is added to the water to put out fires caused by petrol or oil in the traditional method, the sucking of additional foaming agent with a suitable ratio is carried out by means of injectors installed on the water supplying pipe.

As for special objects where fires are allowed to be extinguished by $CO_2$ only: when the fire alarm sprinkler is broken, the pressure decrease activates the automatic valve open device to receive $CO_2$, start the alarm for workers to evacuate, and then close the ventilator and spray $CO_2$ directly into the burning place.

As for the objects where fires are allowed to be extinguished by specialised foam (or chemical powder): fill the required extinguishing agents in the pressurised containers. When the fire alarm thermal sprinkler is broken, the pressure decrease activates the automatic valve open device to receive $CO_2$, start the alarm for workers to evacuate, cut the power off the protected object and spray the suitable specialised fire extinguishing agent into the burning place.

As for the fires where there is no fixed spray network: use the fire hose installed in the walls for extinguishing.

e. Installation: the Whole System can be Installed Fixedly or on Moving Vehicles, Even in the Places where there is Absolutely no Electricity or Generator.

2. Automatic Fire Extinguishing System Using Liquefied $CO_2$ to Regulate the Distribution of Fire Extinguishing Agents Consists of the Following Equipment:

The ordinary water tank for fire extinguishing.

The containers providing sufficient liquefied $CO_2$ for the whole process of fire extinguishing, creating new fire extinguishing agents and automating the process.

The scale or device for automatic checking the weight of $CO_2$ permanently. When $CO_2$ is lower than the needed amount, it will start the alarm signal.

The automatic pressure adjusting device

The reversing device closing the valve to supply $CO_2$ to the high pressurised water tank and to discharge $CO_2$ for the tank running out of $CO_2$.

The reversing device open/closing the valve to supply the fire extinguishing agent from the high pressure tank to the distribution system.

The device for receiving signals from the fire alarm system, automatically opening the valve supplying the fire extinguishing agent from the distribution to the alarm bell and to the power switch-off device of the object to be protected, and then to the fire extinguishing drencher.

Two high pressure tanks placed at positions favourable for receiving the naturally returning fire extinguishing agent with level indicating float valves at the bottom: when the fire extinguishing agent is running out, the float is lowered opening the valve connecting to the $CO_2$ supply to the reversing devices to open the valve supplying $CO_2$ to create pressure for the tank filled with water and discharging pressure for the running-out tank to receive the returning fire extinguishing agent.

The fire alarm self-breaking sprinkler discharges pressure when the temperature increases to the required level.

The fire alarm bell or water bell operate for people to evacuate when the fire extinguishing agent is sprayed.

The device using pressure to switch off power for the object to be protected so as to ensure safety during the fire extinguishing process.

The pipeline and the automatic valve supplying $CO_2$ to the high pressure containers of specialised fire extinguishing agents, the devices for alarm, power switch-off and closing ventilators when receiving the fire alarm signals to put out the fire for special objects.

The safety valve and the pressure meter for the high pressure tanks, specialised high pressure drenchers for spraying water mist when water is needed to put out fires caused by petrol or oil.

The self-sucking injectors to supplement foaming agent with a suitable ratio added to water to put out fires caused by petrol or oil, using the flow of water circulating in the pipe as a sucking dynamic.

The device using pressure to reverse the closing gate of the ordinary water waste system and opening gate to allow the fire extinguishing agent to return to the settling, filtering and oil separating system.

The system for settling, filtering, oil separating and the system for regulating and distributing the reserved water to fill up the receiving container promptly.

Valves, pipe, hose, the fire extinguishing equipment installed in the walls.

All the high pressure devices are interconnected by pressure sustainable pipe and provided with enough pressure by $CO_2$ dissolved in the fire extinguishing agent.

With the liquefied $CO_2$, water or any fire extinguishing agent which is defined on the basis of the standards and regulations for fire protection and prevention, the physical and chemical properties of $CO_2$ as well as the technological specifications of the object to be protected.

3. New fire extinguishing agents are produced by the method described in 1 by means of: filling the already known fire extinguishing agents in the system described in 2 so that $CO_2$ under operating pressure dissolves in them, creating new fire extinguishing agents, which have the function of extinguishing fires owing to their inherent nature and that of carrying and discharging $CO_2$ into the burning place right in the first spray to increase the fire extinguishing effect.

4. Liquefied $CO_2$ mentioned in 1, 2, 3 can be replaced by any non-inflammable compressed gas or liquefied gas.

4. BRIEF DESCRIPTION OF DRAWINGS

FIG. 1: The diagram of the automatic fire extinguishing system using liquefied $CO_2$ to regulate the distribution of fire extinguishing agents.

5. DETAILED DESCRIPTION OF THE INVENTION a. Preparation for Fire Extinguishing Installing the system as in FIG. 1.

Putting the liquefied $CO_2$ containers on scale 2, or using the specialised device to measure the level of $CO_2$ so that it regularly checks the weight and gives alarm in case of shortage.

Connect the liquefied $CO_2$ container 1 to the pressure regulator 3, the pressure meter 4 through the high pressure pipe delivering $CO_2$ to the automatic devices for opening/closing valves 5, 6, 7, 8.

First, the device 5 opens the valve to connect $CO_2$ to the container filled with the fire extinguishing agent 11.

At the same time, device 6 opens to connect container 11 to the device 7.

The specialised fire extinguishing agent for object 27 is contained in container 29. If there are various objects that need different specialised fire extinguishing agents, apply this type of branching pipeline.

The $CO_2$ pressure, after being regulated, is often maintained between 5 and 8 bar during operation, and thus the system is ready to work.

*Notice: For the connectors, we must use the suitable glue to ensure absolute tightness and durability. After the installation is completed, we must test the pressure in accordance with the regulations.

b. In Fire Extinguishing Process:

Device 7 has a valve which is normally closed and only opens when receiving the signal of pressure decrease due to the breaking of the fire alarm sprinkler 13, to supply the fire extinguishing agent to alarm bell 15 and power switch-off device 16, then it sprays the fire extinguishing agent through drencher 14 to object 26.

Device 8 has a valve which is normally closed and it only opens when receiving the signal of pressure decrease due to the breaking of fire alarm sprinkler 17, to supply the specialised fire extinguishing agent from the container 29 to the fire alarm 19, the power switch-off device, closing the ventilator 16 and start the drencher 18 to put out the fire at the special object 27.

Device 25 normally closes the settling and oil separating system 24, and it only opens when device 7 opens the valve. At the same time, it reverses to close the system which discharges the water waste into the ordinary drainage gutter 23. allowing the fire extinguishing agent to return to device 24.

The process of reversing devices 5, 6 continues when floats 9 and 10 alternatively operate.

Injector 28 sucks the foaming agent 30 into the system (when we need to put out the fire caused by petrol or oil in the traditional method).

The $CO_2$ supply creates pressure and dynamic for the operation of the automatic control system and the moving direction in the device 5 is from A to B and C. When the fire extinguishing agent in the tank 11 is low, $CO_2$ moves to D, float 9 is lowered, opening the valve to allow $CO_2$ to move to E and F. At E it activates device 5 reverse the direction, opening the valve to supply $CO_2$ to container 12 (filled) and discharging $CO_2$ in container 11 (to receive the returning fire extinguishing agent). At F it reverses the direction of device 6 opening the valve to supply the fire extinguishing agent from container 12 and continues to spray it into the fire.

Device of regulating and distributing 24 receives the whole amount of returning water and part of the supplementary from the reserved tank 31 if the amount of returning water is insufficient in order to fill the high pressure tank promptly.

The waste $CO_2$ is conducted through pipeline 33 to be disposed in the safe area, or discharged into the fire if permitted.

The hose 32 is for extinguishing fires out of the area protected by the fixed drenchers.

6. EFFECT OF THE INVENTION

1. Inheriting the traditional fire extinguishing method, but we could control the energy completely: The use of $CO_2$ to push water on the basis of the physical and chemical properties of $CO_2$ and the technological solutions to make good use of those typical characteristics. In concrete:

1.1 $CO_2$ is basically the fire extinguishing agent which is widely used. It is not necessarily be produced, but is often recovered from the industrial waste gases at low cost, in great quantity contributing to the reduction of the greenhouse effect.

1.2 In normal condition, liquefied $CO_2$ is contained in die steel containers with pressure being approximately 80 bar, mass density 0.774 ton/m3, volume density 1.29 m3/ton, freezing point −56.6 C.

1.3 The expansion coefficient of volume: When changing from liquid to gas at normal temperature and pressure, 1 ton of liquefied $CO_2$ in crease in volume from 1.29 m3 to about 555 m3, and when it expands to 5 bar pressure, it has a volume of 111 m3. This means 1 ton of liquefied $CO_2$ (1.29 m3) when turned into gas can push 111 m3 of water out of the container under a pressure P=5 bar.

2. High Economic-Technological Effect:

The basic particular feature of the fire extinguishing systems is that they cannot produce benefit by themselves to recover the invested capital and maintenance and operation costs. When we use $CO_2$ to push water, the system can have internal energy for operation; therefore, we do not need to supply energy during the stand-by period and fire extinguishing operation. We do not need to make an initial investment in the system of power line, power transformer stations, the electricity-operated fire extinguishing pumps, reserved generators, pumps to maintain pressure. Therefore we can save hundreds and even billions of VND. At the same time, we do not have to pay for petrol, oil, grease, battery, electricity, water, labour for operating and maintaining daily, which may cost additional tens of millions of VND. Using only 1 ton of liquefied $CO_2$, we can push 111 tons of water in tension 5 bar. This is the scientific basis to ensure the economic technological effect of the solution.

3. With a Fire Extinguishing System Using Liquefied $CO_2$ to Regulate the Distribution of Fire Extinguishing Agents, we can Put Out Fires for Various Objects Having Different Physical and Chemical Properties:

A pumping fire extinguishing system has to use 3 pumps, but it can push only a particular liquefied fire extinguishing agent. However, with $CO_2$ we can favourably use different branches. While one branch pushes water, another can push water and suck foaming agent by means of injectors, in other branches for pushing chemical foam or fire extinguishing powder into special areas to minimise the damage caused by water at the same time to the objects to be protected, which often have items of different physical and chemical properties within a site. In a addition, the fire system will be ready to operate in extinguishe emergency even when the temperature below 0 C.

In particular, $CO_2$ has a natural pressure of 80 kg/cm2, ten times higher than that of ordinary pumps; therefore, it is easy to increase the flow and spraying distance by increasing the pressure after being adjusted, especially when it is used in combination with the fire extinguishing system installed in the walls.

Under the working pressure (5–8 bar), $CO_2$ is dissolved in water to a great extent (between 3–5 liters $CO_2$/1 liter of water); therefore right in the first spray, after coming out of the drencher, the pressure falls suddenly, $CO_2$ is released from each droplet wherever it goes, creating the effect of turning water into mist. Thus, when the pressure is adjusted correctly and the suitable drencher is used, we can expand the area of using water to put out fires caused by petrol or oil instead of expensive fire extinguishing chemicals. At the same time, we can avoid deteriorating petrol and oil after fire extinguishing and causing environmental pollution.

When using water to dissolve the foaming agent to extinguish fire caused by petrol or oil in the traditional method, we can use injectors to suck the foaming agent (or mixing in advance with suitable proportion) and still use $CO_2$ as a pushing gas:

4. We can Extinguishing Fires Promptly Owing to Instant Start:

While the automatic fire extinguishing using pumps according to the current regulations are allowed up to 180 seconds to start the machines, which can hardly be attained in reality, the automatic fire extinguishing system using $CO_2$ to regulate the distribution of fire extinguishing agents, the fire extinguishing is almost "instantly". Therefore, we can possibility put out the fire right at the moment it starts, reducing the damage and cost of fire extinguishing, increasing reliability. In reality, this system does not have negative pressure as when we use pumps; therefore, it is easy to ensure tightness, eliminate noise, hydraulic vibration as well as to avoid troubles due to water sucking failure.

5. The Simple Structure but it is Fully Automatic.

This system uses the compressed $CO_2$ to transmit signals and supply all the energy to the automatic the whole fire extinguishing systems.

Without using electricity, the system itself does not cause risks of fire or explosion to the object to be protected, and it is ready to put out fires for itself in case of fire. Anyone can check the reliability and the readiness for operation by eyes (only looking at the meter). When necessary, we can test the system quickly and reset it easily.

6. Saving Land Area and Construction Cost:

In many cases, we can make good use of the returning water. The method of recycling the water for fire extinguishing can reproduce a great amount of water right in the process of putting out the fire. It can help to reduce the capacity of the tank a lot, "gain" the amount of reserved stand by water and environmental pollution. The system can be installed underground, so we can save the land area and construction cost, which is very suitable for small-sized sites, high buildings, super high T.V towers and the sites with concrete and centralised water drainage system, or the constructions of which the recycling systems are being designed in the period of building or rebuilding.

7. $CO_2$ can Clean the System:

$CO_2$ can destroy bacteria, weeds, and at the same time does not produce oxidisation, rust, hardening rubber, rubber washers, thus increasing the reliability of the system.

8. Apart from liquefied $CO_2$, the system can also run by dynamic from other high pressure fire extinguishing gas sources. But we should notice that these gas sources have some disadvantages: they have double high pressure but the amount of gas in the container is only half compared with liquefied $CO_2$; therefore we must use double the number of containers which is more expensive and less safety.

Notes for FIG. 1

(1) Liquefied $CO_2$ source
(2) Automatic scale for checking the amount of $CO_2$ and gives alarm in case of $CO_2$ shortage
(3) $CO_2$ pressure adjuster
(4) Meter for adjusting $CO_2$ pressure
(5) Reverse device supplying $CO_2$ to create pressure for tank (11) or (12)
(6) Reverse device supplying fire extinguishing agents from tank (11) or (12)
(7) Device for receiving fire alarm signal (13), supplying fire extinguishing agents to the drencher (14), starting alarm bell (15), switching off power (16) of the object to be protected (26).
(15) Device receiving fire alarm signal (16'), supplying $CO_2$ and specialised chemical agents from container (29) to the fire extinguishing drencher (18), starting the fire alarm bell (19) to put out the fire for the object (27). If necessary, we can install additional devices for switching off power and closing or opening the ventilating system (not included in the figure).
(9), (10) Level indicating float: when the level of fire extinguishing agent is low, the float is lowered opening the valve to supply $CO_2$ to the devices (5) and (6).
(11), (12) The high pressure tanks installed at the positions favourable for alternatively supplying and receiving the returning fire extinguishing agent.
(13) Fire alarm thermal sprinkler giving signal to the device (7)
(14) Fire extinguishing drencher (15) Fire alarm bell for object (26)
(16) Device for switching off power
(17) Fire alarm thermal sprinkler giving signal to the device (8)
(18)) Fire extinguishing drencher for object (27)
(19) Fire alarm bell for object (27)
(20) Safety valve for high pressure tanks (11) and (12)
(21) Pressure meter for high pressure tanks (11) and (12)
(22) One-way valve for receiving returning fire extinguishing agent
(23) Ordinary waste water drainage system
(24) System for settling, filtering and processing of returning fire extinguishing agent
(25) Device for receiving signals from valve (6) reversing the direction to close the ordinary waste water pipe (23), to open allowing the returning coming into the processing system (24)
(26) Object to be protected which allows fire extinguishing by means of any fire extinguishing agent
(27) Object which allows fire extinguishing by means of $CO_2$ or specialised fire extinguishing agent
(28) Injector sucking additional fire extinguishing for the system
(29) Container for specialised fire extinguishing agent (not needed when $CO_2$ is in use)
(30) Container for foaming agent
(31) Ordinary tank for reserved water to put out fires
(32) Fire extinguishing hose installed in the walls
(33) Pipe discharging $CO_2$ into the safe area.

What is claimed is:

1. An automatic fire extinguishing system using liquefied $CO_2$ to regulate the distribution of fire extinguishing agents, said system consisting of the following equipment:

an ordinary water tank for fire extinguishing;

containers providing sufficient liquefied $CO_2$ for the whole process of fire extinguishing, creating new fire extinguishing agents and automating the process;

a scale or device for automatically checking the weight of $CO_2$ permanently, wherein when $CO_2$ is lower than the needed amount, it will start an alarm signal;

an automatic pressure adjusting device;

a reversing device closing the valve to supply $CO_2$ to the high pressurized water tank and to discharge $CO_2$ for the tank running out of $CO_2$, a reversing device open/closing the valve to supply the fire extinguishing agent from the high pressure tank to a distribution system;

a device for receiving signals from the fire alarm system, automatically opening the valve supplying the fire extinguishing agent from the distribution to an alarm bell and to a power switch-off device of the object to be protected, and then to a fire extinguishing drencher;

two high pressure tanks placed at positions favorable for receiving a naturally returning fire extinguishing agent with level indicating float valves at the bottom, wherein when the fire extinguishing agent is running out, the float is lowered opening the valve connecting to the $CO_2$ supply to the reversing devices to open the valve supplying $CO_2$ to create pressure for the tank filled with water and discharging pressure for the running-out tank to receive the returning fire extinguishing agent;

a fire alarm self-breaking sprinkler which discharges pressure when the temperature increases to the required level;

the fire alarm bell or water bell which starts for people to evacuate when the fire extinguishing agent is sprayed;

the device using pressure to switch off power for the object to be protected so as to ensure safety during the fire extinguishing process;

a pipeline and an automatic valve supplying $CO_2$ to the high pressure containers of specialized fire extinguishing agents, the devices for alarm, power switch-off and closing ventilators upon receiving the fire alarm signals to put out the fire for special objects;

a safety valve and a pressure meter for the high pressure tanks, specialized high pressure drenchers for spraying water mist when water is needed to put out fires caused by petrol or oil;

self-sucking injectors to supplement foaming agent with a suitable ratio added to water to put out fires caused by petrol or oil, using the flow of water circulating in the pipe as sucking dynamics;

a device using pressure to reverse the closing gate of the ordinary water waste system and opening gate to allow the fire extinguishing agent to return to the settling, filtering and oil separating system;

a system for settling, filtering, oil separating and the system for regulating and distributing the reserved water to fill up the receiving container promptly;

valves, pipe, hose, the fire extinguishing equipment installed in the walls;

all the high pressure devices being interconnected by pressure sustainable pipe and provided with enough pressure by $CO_2$ dissolved in the fire extinguishing agent; and the liquefied $CO_2$, water or any fire extinguishing agent which is defined on the basis of the standards and regulations for fire protection and prevention, the physical and chemical properties of $CO_2$ as well as the technological specifications of the object to be protected.

2. The system of claim 1, wherein said liquefied $CO_2$ can be replaced by any non-inflammable compressed gas or liquefied gas.

* * * * *